US008380524B2

(12) United States Patent
Wu et al.

(10) Patent No.: US 8,380,524 B2
(45) **Date of Patent: *Feb. 19, 2013**

(54) RATE-DISTORTION OPTIMIZATION FOR ADVANCED AUDIO CODING

(75) Inventors: Guixing Wu, Waterloo (CA); En-hui Yang, Waterloo (CA); Longji Wang, Waterloo (CA)

(73) Assignee: Research in Motion Limited, Waterloo (CA)

( * ) Notice: Subject to any disclaimer, the term of this patent is extended or adjusted under 35 U.S.C. 154(b) by 625 days.

This patent is subject to a terminal disclaimer.

(21) Appl. No.: 12/626,653

(22) Filed: Nov. 26, 2009

(65) Prior Publication Data

US 2011/0125506 A1 May 26, 2011

(51) Int. Cl.
*G10L 19/00* (2006.01)

(52) U.S. Cl. ..... 704/500

(58) Field of Classification Search ..... 704/500–504
See application file for complete search history.

(56) References Cited

U.S. PATENT DOCUMENTS

| | | | | |
|---|---|---|---|---|
| 7,272,566 | B2 * | 9/2007 | Vinton | 704/500 |
| 7,328,152 | B2 * | 2/2008 | Yang et al. | 704/229 |
| 7,599,840 | B2 * | 10/2009 | Mehrotra et al. | 704/501 |
| 8,032,371 | B2 * | 10/2011 | Baumgarte | 704/233 |
| 8,149,144 | B2 * | 4/2012 | Mittal et al. | 341/51 |
| 8,204,744 | B2 * | 6/2012 | Wu et al. | 704/230 |
| 2004/0131204 | A1 | 7/2004 | Vinton | |
| 2007/0016415 | A1 * | 1/2007 | Thumpudi et al. | 704/230 |

OTHER PUBLICATIONS

K. Brandenburg, "MP3 and AAC explained," in Proc. AES 17th International Conference on High Quality Audio Coding, 1999, pp. 1-12.

A. Aggarwal, S. L. Regunathan and K. Rose, "Near-optimal selection of encoding parameters for audio coding," in Proc. of ICASSP 2001, pp. 3269-3272, May 2001.

C. Bauer and M. Vinton, "Joint optimization of scale factors and Huffman codebooks for MEPG-4 AAC," in IEEE Trans. on Signal Processing, vol. 54, pp. 177-189, Jan. 2006.

C.-h. Yang and H.-m. Hang, "Cascaded trellis-based rate-distortion control algorithm for MPEG-4 advanced audio coding, " in IEEE Trans. on Speech and Audio Processing, vol. 14, No. 3, pp. 998-1007, May 2006.

M. Bosi and R. E. Goldberg, Introduction to digital audio coding and standards, Kluwer Academic, 2003, pp. 346-352.

J.D. Johnson, "Transform coding of audio using perceptual noise criteria, " in IEEE J. Selec. Areas. Comm., vol. 6, No. 2, pp. 314-323, 1989.

D. P. Bertsekas, "Constrained optimization and Lagrangian multiplier methods," Academic Press, 1982, all.

P.A. Chou, T. Lookabaugh and R. M. Gray, "Entropy-constrained vector quantization, " IEEE Trans. on Acoustics, Speech, and Signal Processing, vol. 37, No. 1, pp. 31-42, 1989.

(Continued)

*Primary Examiner* — Michael N Opsasnick
(74) *Attorney, Agent, or Firm* — Ridout & Maybee LLP

(57) ABSTRACT

A method for optimization of rate-distortion for Advanced Audio Coding (AAC). The method provides for the identification of quantized spectral coefficient sequences for optimization of rate-distortion. The method also provides joint optimization of scale factors, Huffman codebooks and quantized spectral coefficient sequences for minimization of a rate-distortion cost. The method provides an iterative rate-distortion optimization algorithm for AAC encoding. In each iteration, the method first finds the optimal scale factors and quantized spectral coefficients when Huffman codebooks are fixed, then updates Huffman codebooks and quantized spectral coefficients given the optimized scale factors. The iterations may be applied until a predetermined threshold is attained.

15 Claims, 7 Drawing Sheets

OTHER PUBLICATIONS

E.-h. Yang, Z. Zhang and T. Berger, "Fixed-slope universal lossy data compression, " IEEE Trans. on Information Theory, vol. 43, No. 5, pp. 1465-1476, 1997.

E.-h. Yang and Z. Zhang, "Variable rate trellis source coding, " IEEE Trans. on Information Theory, vol. 42, No. 5, pp. 586-607, 1999.

E.-h. Yang, and L. Wang, "Joint optimization of run-length coding, Huffman coding and quantization table with complete baseline JPEG decoder compatibility," U.S. patent application, 2004.

E.-h. Yang, and L. Wang, Joint optimization of run-length coding, Huffman coding and quantization table with complete baseline JPEG compatibility, IEEE, 2007.

E.-h. Yang and X. Yu, "On joint optimization of motion compensation, quantization and baseline entropy coding in H.264 with complete decoder compatibility," in Proc. of ICASSP 2005 II, pp. 325-325, Mar. 2005.

J. Xu and E.h. Yang, "Rate-distortion optimization for MP3 audio coding with complete decoder compatibility," in Proc. 2005 IEEE Workshop on Multimedia Signal Processing, Oct. 2005.

K. Brandenburg, "ODF-A new coding algorithm for high quality sound signals, " In Proc. of ICASSP 1987, pp. 141-144, 1987.

ISO/IEC JTC1/SC29/WG11 (MPEG), International Standard ISO/IEC 13818-7 "Generic coding of moving pictures and associated audio: Advanced Audio Coding," 1997, all.

ISO/IEC JTC1/SC29/WG11 (MPEG), International Standard ISO/IEC 14496-3 "Coding of audio-visual objects: Audio" 1999, all.

Extended European Search Report; Apr. 23, 2010.

Office Action dated Sep. 1, 2011 for corresponding European Patent Application No. 091772667.3.

* cited by examiner

100

110

RATE-DISTORTION OPTIMIZATION FOR ADVANCED AUDIO CODING

FIELD

Example embodiments herein relate to audio signal encoding, and in particular to rate-distortion optimization for Advanced Audio Coding (AAC).

BACKGROUND

Advanced Audio Coding (AAC) has been proposed as the successor to the MPEG-1/2 Layer-3 format (commonly referred to as "MP3") for high quality multi-channel audio transmission. AAC was first specified in the standard MPEG-2 Part 7, and later updated in MPEG-4 Part 3. AAC has found applications in digital audio broadcasting and storage applications such as in portable digital audio devices, the Internet and wireless communications.

Generally, for the AAC standard, the decoding algorithms are predetermined and fixed. However, there may be opportunities to manipulate the encoding algorithm while maintaining full decoder compatibility.

Some differences between AAC and MP3 include the AAC standard providing for the selection of quantization step sizes (which are differentially coded), and selection of Huffman codebooks from a set of 12 Huffman codebooks. Some conventional encoding algorithms are limited to optimization of these two parameters for optimization of rate-distortion in AAC encoding. These two parameters may thereafter be used to configure an encoder.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
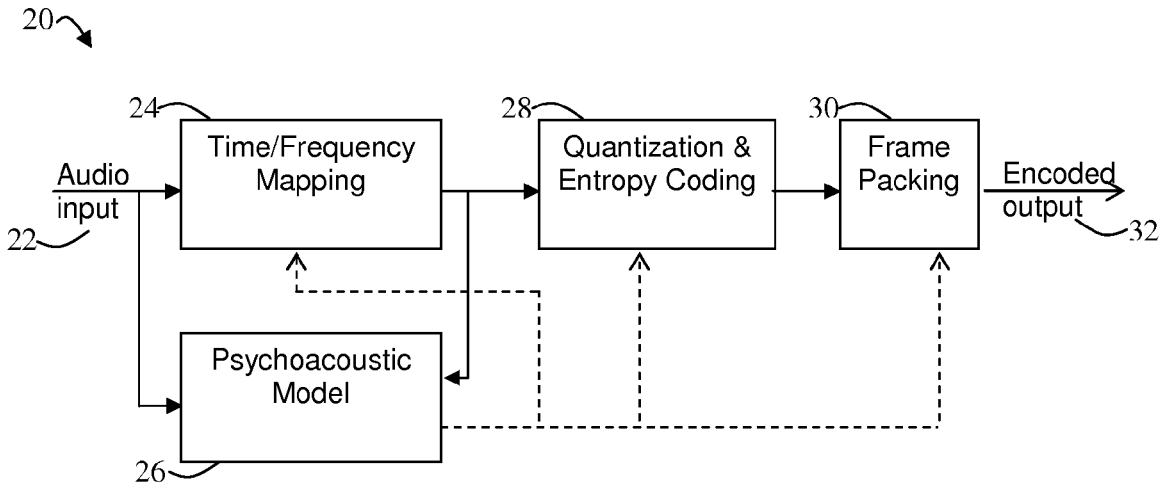
FIG. 1 shows an AAC process to which example embodiments may be applied.

It would be advantageous to provide for the optimization of additional parameters for optimization of rate-distortion in AAC encoding.

In one aspect, the present application provides for the optimization of rate-distortion for AAC encoding based on quantized spectral coefficient sequences.

In another aspect, the present application provides for joint optimization of scale factors, Huffman codebooks and quantized spectral coefficient sequences for optimization of rate-distortion.

In another aspect, the present application provides a method having an iterative rate-distortion optimization algorithm for AAC encoding based on a method of Lagrangian multipliers. In each iteration, the method first finds the optimal values of scale factors and quantized spectral coefficients when Huffman codebooks are fixed, and then updates the values of Huffman codebooks and quantized spectral coefficients given the optimized scale factors. The iterations may be applied until a predetermined threshold is attained.

In another aspect, the present application provides a method for optimizing performance of Advanced Audio Coding of an audio source sequence, the Advanced Audio Coding being dependent on a quantized spectral coefficient sequence, wherein the quantized spectral coefficient sequence is a quantized sequence of the audio source sequence. The method includes determining values of the quantized spectral coefficient sequence which minimize a cost function of an encoding of the audio source sequence within a predetermined threshold, by using soft decision quantization, the cost function being dependent on the quantized spectral coefficient sequence, and performing Advanced Audio Coding of the audio source sequence using the determined quantized spectral coefficient sequence.

In another aspect, the present application provides a method for optimizing performance of Advanced Audio Coding of an audio source sequence, the Advanced Audio Coding being dependent on a quantized spectral coefficient sequence, on a scale factor sequence, and on Huffman codebooks, wherein the quantized spectral coefficient sequence is a quantized sequence of the audio source sequence, the scale factor sequence corresponds to quantization step sizes of the quantized spectral coefficient sequence, and the Huffman codebooks are from a set of selectable Huffman codebooks. The method includes determining values of the quantized spectral coefficient sequence, the scale factor sequence, and the Huffman codebooks which minimize a cost function of an encoding of the audio source sequence within a predetermined threshold, the cost function being dependent on the quantized spectral coefficient sequence, the scale factor sequence, and the Huffman codebooks, and performing Advanced Audio Coding of the audio source sequence using the determined quantized spectral coefficient sequence, the determined scale factor sequence, and the determined Huffman codebooks.

In another aspect, the present application provides an encoder for optimizing performance of Advanced Audio Coding of an audio source sequence, the Advanced Audio Coding being dependent on a quantized spectral coefficient sequence, wherein the quantized spectral coefficient sequence is a quantized sequence of the audio source sequence. The encoder includes a controller, a memory accessible by the controller, and a predetermined threshold stored in the memory. The controller is configured to: access the predetermined threshold from memory, determine values of the quantized spectral coefficient sequence which minimize a cost function within the predetermined threshold, by using soft decision quantization, the cost function being dependent on the quantized spectral coefficient sequence, and store the determined quantized spectral coefficient sequence in memory for Advanced Audio Coding of the audio source sequence.

In another aspect, the present application provides an encoder for optimizing performance of Advanced Audio Coding of an audio source sequence, the Advanced Audio Coding being dependent on a quantized spectral coefficient sequence, a scale factor sequence, and Huffman codebooks, wherein the quantized spectral coefficient sequence is a quantized sequence of the audio source sequence, the scale factor sequence corresponds to quantization step sizes of the quantized spectral coefficient sequence, and the Huffman codebooks are from a set of selectable Huffman codebooks. The encoder includes a controller, a memory accessible by the controller; and a predetermined threshold stored in the memory. The controller is configured to: access the predetermined threshold from memory, determine values of the quantized spectral coefficient sequence, the scale factor sequence, and the Huffman codebooks which minimize a cost function of an encoding of the audio source sequence within the predetermined threshold, the cost function being dependent on the quantized spectral coefficient sequence, the scale factor sequence, and the Huffman codebooks, and store the determined quantized spectral coefficient sequence, the scale factor sequence, and the Huffman codebooks in memory for Advanced Audio Coding of the audio source sequence.

Reference is now made to FIG. 1, which shows an AAC process 20 to which example embodiments may be applied. The AAC process 20 may for example be implemented by a suitably configured encoder, for example by a computer having a memory with suitable instructions stored thereon. The AAC process generally processes digital audio and produces an encoded or compressed bit stream for storage and transmission. In FIG. 1, the continuous lines denote the time or spectral domain signal flow, and the dash lines denote the control information flow. As shown, the AAC process 20 includes audio input 22 for input to a time/frequency (T/F) mapping module 24 and a psychoacoustic model module 26. Also shown are a quantization and entropy coding module 28 and a frame packing module 30. The AAC process 20 results in an encoded output 32 of the audio input 22, for example for sending to a decoder for subsequent decoding.

The audio input 22 may for example be time domain audio samples which are first preprocessed (as is known in the art; not shown) and sent into the T/F mapping module 24 which converts the audio input 22 into spectral coefficients. The T/F mapping module 24 shown is for example a time-variant modified discrete cosine transform (MDCT). The transform length could be set to 1024 (long block) or 128 (short block) time samples. The long block is used to address stationary audio signals. This may ensure a higher frequency resolution, but may also cause quantization errors spreading over the 1024 time samples in the process of quantization. The short block is used to reduce temporal noise to spread for the signals containing transients/attacks. In order to ensure a smooth transition from a long block to a short block and vice versa, two transition blocks, long-short (start) and short-long (stop), which have the same size as a long block, may be employed. The time-variant MDCT is used to generate a frame of 1024 spectral coefficients. One spectral frame may contain one long block sequence (including long-short and short-long) and eight short block sequences.

The psychoacoustic model module 26 is generally used to generate control information for the T/F mapping module 24 and the quantization and entropy coding module 28. Based on the control information from the psychoacoustic model module 26, spectral coefficients received from the T/F mapping module 24 are sent to the quantization and entropy coding module 28, and are quantized and entropy coded, resulting in quantized spectral coefficients. These encoded bit streams are packed up along with format information, control information and other auxiliary data in AAC frames, and are sent as encoded output 32.

Generally, the AAC syntax leaves the selection of quantization step sizes and Huffman codebooks to the encoder implementing the AAC process 20. The spectral coefficients received at the quantization and entropy coding module 28 are first quantized using the selected quantization step sizes and then further encoded using Huffman codebooks from a set of selectable Huffman codebooks. The AAC syntax for example specifies twelve fixed Huffman codebooks. In addition, the indices of scale factors (SFs) and Huffman codebooks are coded and transmitted as side information. In AAC, the SFs are differentially coded relative to the previous SF, and then Huffman coded using a fixed Huffman codebook. The indices of Huffman codebooks used for the encoding of the quantized spectral coefficients are coded by run-length codes.

In some conventional AAC algorithms, optimization of rate-distortion has been limited to these two parameters of quantization step sizes and Huffman codebooks. In such systems, to optimize those two parameters, a two nested loop search (TNLS) algorithm is commonly used. The TNLS search in such applications uses a heuristic search, which may not be guaranteed to converge. In addition, quantization and Huffman coding are considered separately.

Therefore, referring still to FIG. 1, in conventional systems the AAC quantization and entropy coding module 28 first groups an entire frame of 1024 spectral coefficients into a number of scale factor bands. Each coefficient $xr_i$, i=0 to 1023, is quantized by the following non-uniform quantizer:

$$y_i = nint\left[\left(\frac{|xr_i|}{\left(\sqrt[4]{2}\right)^{global_gain-scale_factor[sb]}}\right)^{0.75} - 0.0946\right] \tag{2.1}$$

where $y_i$ denotes the quantized index, nint denotes the nearest non-negative integer, global_gain determines the overall quantization step size for the entire frame, and scale_factor [sb] is used to determine the actual quantization step size for scale factor band (SFB) sb where the spectral coefficient $xr_i$ lies to make the perceptually weighted quantization noise as small as possible. In AAC encoding global_gain is usually set to be equal to scale_factor[0]. The formulaic calculation of $y_i$ may conveniently be referred to as "hard decision quantization".

In some conventional algorithms, to minimize the quantization noise, a noise shaping method needs to be applied to find the proper global quantization step size global_gain and scale factors before the actual quantization. Some conventional algorithms use the TNLS algorithm to jointly control the bit rate and distortion. The TNLS algorithm may require quantization step sizes so small to obtain the best perceptual quality. On the other hand, it has to increase to the quantization step sizes to enable coding at the required bit-rate. These two requirements are conflicting. Therefore, this algorithm does not guarantee to converge. Moreover, the scale factors and Huffman codebooks are considered separately in the TNLS algorithm.

In some example embodiments described herein, it is identified to use quantized spectral coefficients as another free parameter to which an AAC encoder can optimize. Generally, in some example embodiments, a method is provided to jointly optimize the quantized coefficients, quantization step sizes and Huffman codebooks. The method may for example be based on the method of Lagrangian multipliers, as can be implemented by those skilled in the art.

In some example embodiments, one purpose is to achieve the minimum perceptual distortion for a given encoding rate. Mathematically, the following minimization problem is to be solved:

$$\begin{cases} \min_{y,s,h} D_w(xr, rxr), \text{ subject to} \\ R(s) + R(h) + R(y) \le R_1 \end{cases} \tag{3.1}$$

where xr is the original spectral signal sequence, rxr is the reconstructed signal sequence, y is the quantized spectral coefficient sequence, $s=\{s_0, s_1 \ldots\}$ is the scale factor sequence, h is the Huffman codebook index sequence ("Huffman codebooks"), R(s), R(y) and R(h) are the bit rates for transmitting s, y and h respectively, $R_1$ is the rate constraint, and $D_w$ (xr, rxr) denotes the weighted distortion measure between xr and rxr. Generally, average noise-to mask ratio (ANMR) may be used as the distortion measure. The noise-to mask ratio (NMR), the ratio of the quantization noise to the masking threshold, is the mostly widely used objective measure for the evaluation of an audio signal. ANMR is expressed as:

$$ANMR = \frac{1}{N}\sum_{sb=1}^{N} w[sb]\cdot d[sb] \tag{3.2}$$

where N is the number of scale factor bands, w[sb] is the inverse of the masking threshold for scale factor band sb, and d[sb] is the quantization distortion, mean squared quantization error for scale factor band sb.

The above constrained optimization problem could be converted into the following minimization problem:

$$\min_{y,s,h} J_\lambda(y,s,h)=D_w(xr,rxr)+\lambda\cdot(R(s)+R(h)+R(y)) \tag{3.3}$$

where λ is a fixed parameter that represents the tradeoff of rate for distortion, and $J_\lambda$ is commonly referred to as the "Lagrangian cost", as can be understood by those skilled in the art. From the rate-distortion theoretic point of view, one object of audio compression design is to find a set of encoding and decoding schemes to minimize the actual rate-distortion cost given by (3.3). However, for the standard-constrained optimization described herein, in some example embodiments, the decoding algorithms have already been selected and fixed. What may be optimized is the encoding algorithm while maintaining full decoder compatibility.

Since AAC employs differential coding of scale factors and run-length coding of Huffman codebook indices, this may introduce significant inter-band dependencies in coding of the side information. The absolute difference between the scale factor values of two neighboring scale factor bands should be restricted within a dynamic range of 60, and the scale factor value is differentially encoded relative to the one of the preceding band (or the global gain for the first band) by a fixed Huffman codebook. The whole quantized spectrum is segmented into sections whose boundaries are aligned with those of scale factor bands, such that a single Huffman codebook is used to code each section. The indices of Huffman codebooks are coded by run-length codes. Therefore, R(s) can be decomposed as $$R(s) = \sum_{i=0}^{N-1} R_s(s_i - s_{i-1}) \tag{3.4}$$

and R(h) as $$R(h)=\Sigma R_h(h_i,\text{run}(h_i)) \tag{3.5}$$

where N denotes the total number of scale factor bands of one spectral frame, $R_s$ determines the number of side information bits needed to encode the scale factor $s_i$ of band i as a function of $s_i$ and $s_{i-1}$, $R_h$ represents the number of bits to encode Huffman codebook index $h_i$ for band i as a function of $h_i$ and the length of $h_i$, run($h_i$), and the summation in (3.5) is over all pairs of ($h_i$, run($h_i$)) along with the Huffman codebook index sequence. Here $s_{-1}$ is equal to global_gain.

In (3.3) the bit rates to transmit the scale factors, R(s) and Huffman codebook indices R(h), depend on the actual scale factors and Huffman codebook indices transmitted, and the bit rate to transmit the quantized coefficients R(y) is determined by the actual Huffman codebook.

Some conventional systems have limited the optimization algorithms to the two above-mentioned parameters of scale factors and Huffman codebooks. The conventional hard decision quantization methods consider y solely determined by scale factors given xr, i.e., y=Q(xr, s) (e.g. (2.1)). On the other hand, in some example embodiments, some of the methods described herein also consider the optimization of the quantized spectral coefficient sequence y. This may be referred to herein as "soft-decision quantization" (rather than hard decision quantization), such that y is chosen as a parameter to minimize the rate-distortion cost (3.3).

Figure 2:
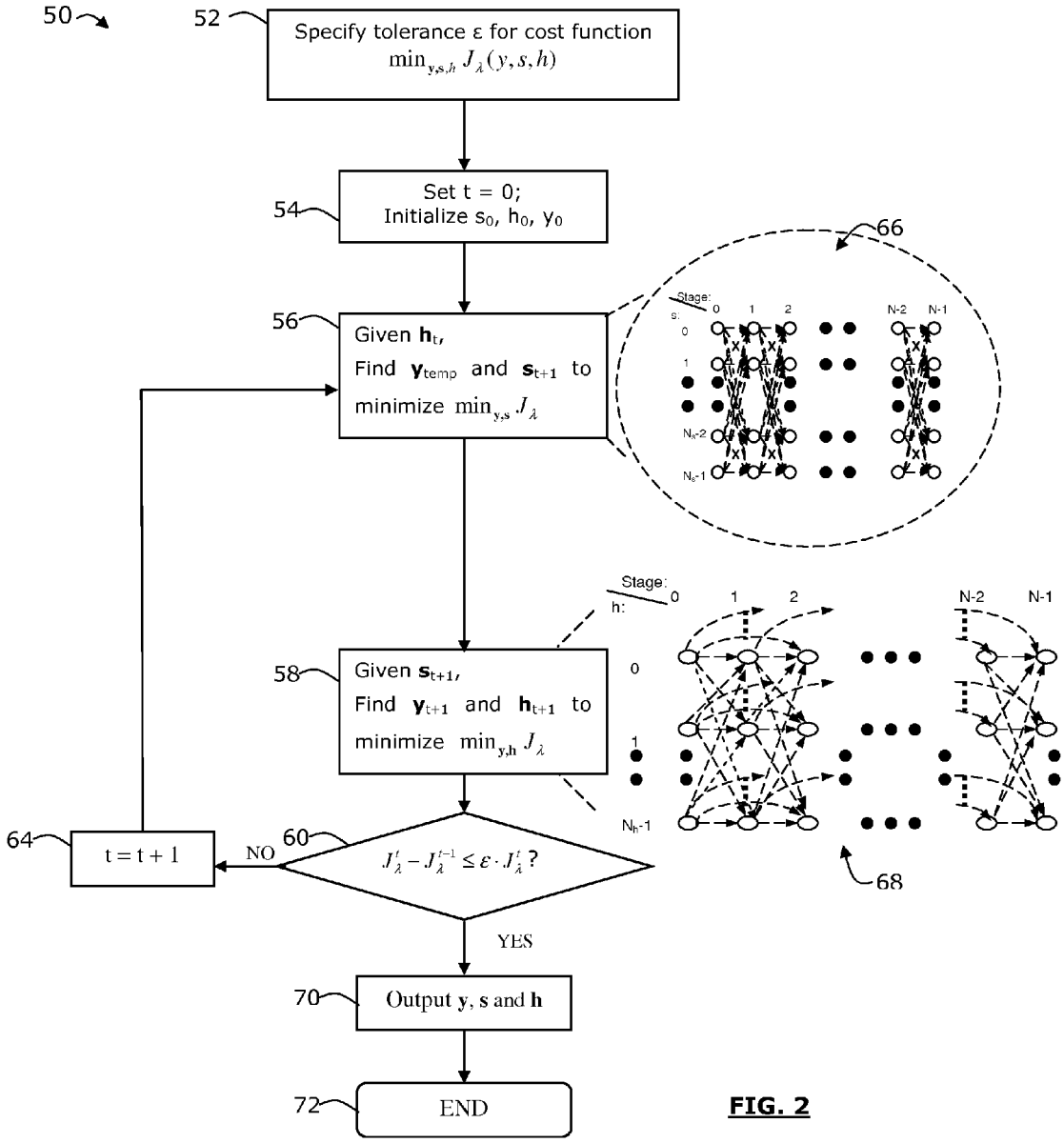
FIG. 2 shows an optimization process in accordance with an example embodiment.
Figure 3:
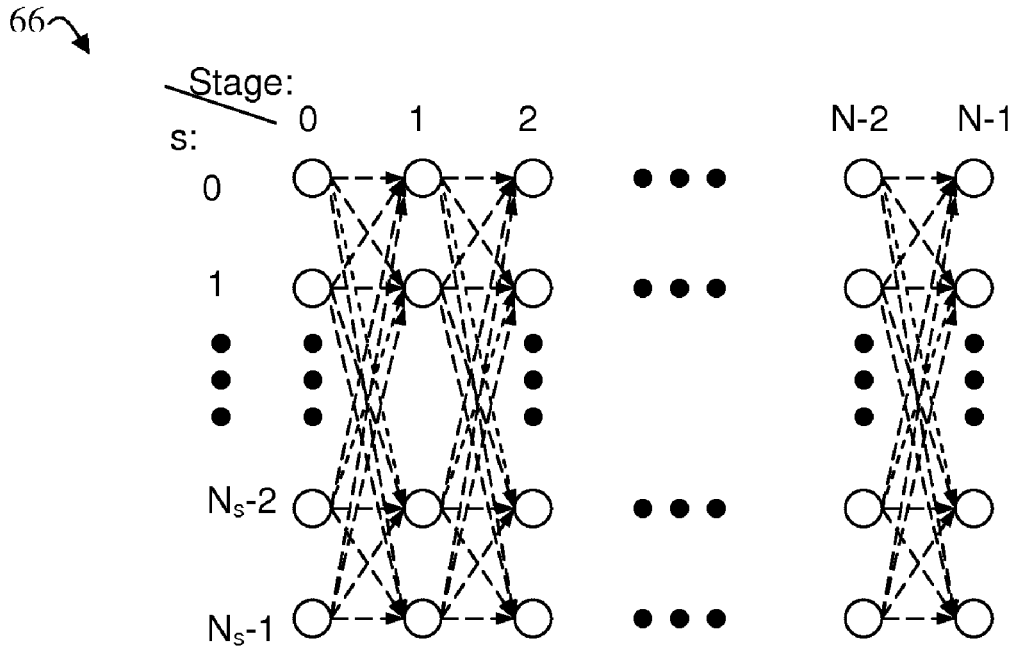
FIG. 3 shows a detailed example Trellis process to be used in the optimization process of FIG. 2.
Figure 4:
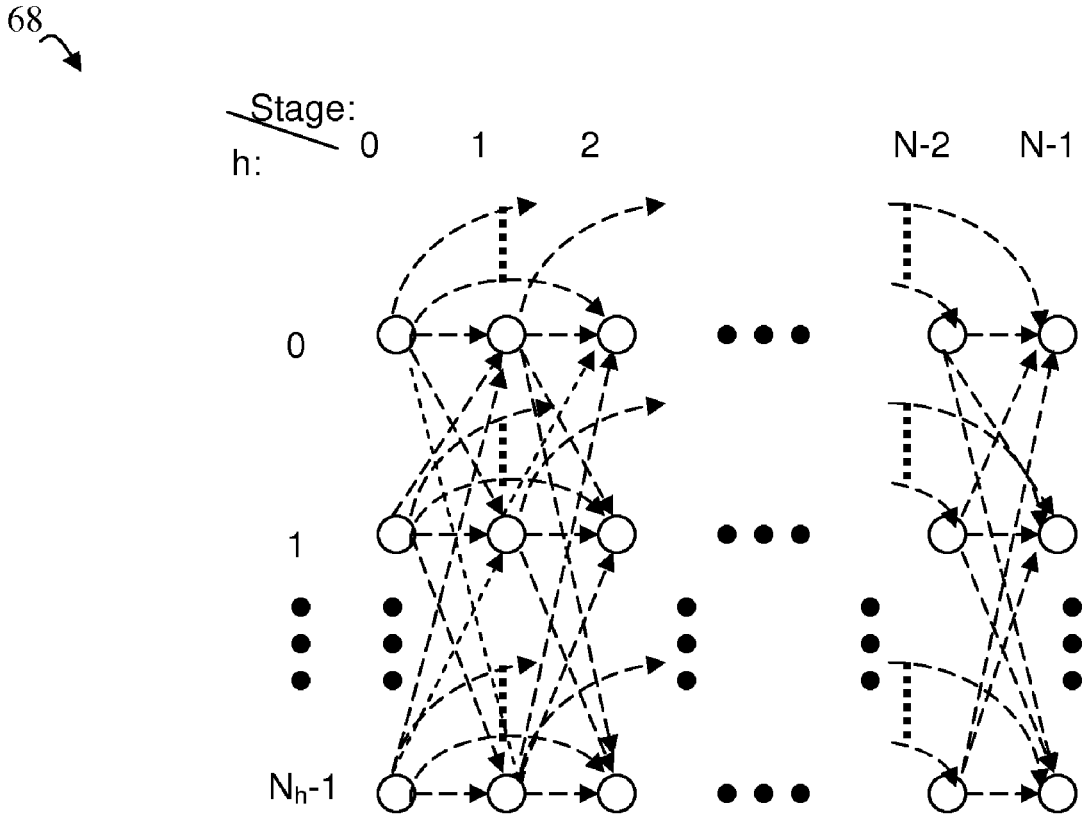
FIG. 4 shows another detailed example Trellis process to be used in the optimization process of FIG. 2.

Reference is now made to FIGS. 2, 3 and 4, wherein FIG. 2 shows an optimization process 50 in accordance with an example embodiment, and FIG. 3 shows a detail of an example Trellis process 66 to be used in the optimization process 50 of FIG. 2, and FIG. 4 shows a detail of another example Trellis process 68 to be used in the optimization process 50 of FIG. 2. The Trellis process 66 is an example Trellis-based implementation of step 56 of the optimization process 50. The Trellis process 68 is an example Trellis-based implementation of step 58 of the optimization process 50. Generally, the optimization process 50 includes an alternating minimization procedure to optimize the scale factors s and Huffman codebooks h alternatively to minimize the Lagrangian cost. The exact order of steps may vary from those shown in FIGS. 2 and 3 in different applications and embodiments. It can also be appreciated that some steps may not be required in some example embodiments.

The optimization process 50 is as follows. At step 52, specify a threshold or tolerance ϵ as the convergence criterion for the Lagrangian cost. At step 54, initialize a set of scale factors $s_0$ and quantized indices $y_0$ from the given frame of spectral domain coefficients xr with a Huffman codebooks selection mode $h_0$; and set t=0. Compute $J_\lambda$(y, s, h), and denote is as $J_\lambda^0$.

At step 56, $h_t$ is fixed or given for any t≧0. Find the optimal quantized spectral coefficient sequence $y_{temp}$ and scale factors $s_{t+1}$ where $y_{temp}$ and $s_{t+1}$ achieve the minimum $$\min_{y,s} J_\lambda=D_w(xr,Q^{-1}(s,y))+\lambda\cdot(R(s)+R(h)+R(y)) \tag{3.6}$$

where $Q^{-1}$(s,y) is the inverse quantization function to generate the reconstructed signal rxr. This step may for example be implemented by a Trellis process 66 (FIG. 3), which is described in greater detail below.

At step 58, given $s_{t+1}$, find the optimal quantized coefficients $y_{t+1}$ and Huffman codebooks $h_{t+1}$ where $y_{t+1}$ and $h_{t+1}$ achieve the minimum $$\min_{y,h} J_\lambda = D_w(xr; Q^{-1}(s,y)) + \lambda \cdot (R(s) + R(h) + R(y)) \tag{3.7}$$

This step 58 may for example be implemented by a Trellis process 68 in a similar manner as Trellis process 66. Compute $J_\lambda(y_{t+1}, s_{t+1}, h_{t+1})$, and denote is as $J_\lambda^{t+1}$.

At step 60, query whether $J_\lambda^t - J_\lambda^{t+1} \leqq \epsilon \cdot J_\lambda^t$. If so, the optimization process 50 proceeds to step 62 and outputs the final y, s and h, and ends at step 72. If not, proceed to step 64 wherein t=t+1, and repeat steps 56 and 58 for t=0, 1, 2, . . . until $J_\lambda^t - J_\lambda^{t+1} \leqq \epsilon \cdot J_\lambda^t$. Since the Lagrangian cost function may be non-increasing at each step, the convergence is guaranteed. The final y, s and h may thereafter be provided for AAC coding of xr.

Steps 56 and 58 will now be explained in greater detail, which may for example be solved by applying dynamic programming for the soft decision quantization. Reference is now made to FIG. 3, which shows the Trellis process 66 to be used for step 56. The number of states at each stage is $N_s$ (or any suitable $N_x$, depending on the parameter used for minimization). Each state at the ith stage represents an SF candidate (i.e., s) for the ith SFB. Denote these states as $\gamma_{k,i}$ where $0 \leqq k < N_s$ and $0 \leqq i < N$. Denote $J_{k,i}$ as the minimum accumulative cost from stage 0 to $\gamma_{k,i}$. The state transition cost from $\gamma_{l,i-1}$ to $\gamma_{k,i}$ is $\lambda \cdot R_s(s_i - s_{i-1})$. The optimization procedure for the Trellis process 66 (step 56) is described as follows:

1) For each state in the Trellis, find the best $y_{k,i}$, to minimize the incremental cost in the state by applying soft decision quantization. The minimum incremental cost $C_{k,i}$ is equal to $$C_{k,i} = \min_{y_{k,i}} \{D_w(xr_i, Q^{-1}(s_{k,i}, y_{k,i}) + \lambda \cdot R(y_{k,i})\}. \tag{3.8}$$

Thus, each state of the Trellis is associated with each minimal incremental cost $C_{k,i}$. The determination of $y_{k,i}$ may for example be found by searching all possible and allowable quantized coefficients as determined by the particular Huffman codebook. In other example embodiments, the search range for $y_{k,i}$ is limited to $[yh_j - a, yh_j + a]$, where $yh_j$ is the jth quantized coefficient from hard decision quantization (e.g., using (2.1)) and a is a fixed integer.

2) Initialize all the states and start Trellis search from the initial stage. $J_{k,0} = C_{k,i} + \lambda \cdot R_s(0)$, for all k and i=0.

3) For each state at the ith stage, find the best accumulative cost to the ith stage by examining all the states at the (i−1)th stage leading to the current state. The best path ending at $\gamma_{k,i}$ is the one that has the minimum accumulative cost $J_{k,i}$. $J_{k,i}$ is defined as $$J_{k,i} = \min_l \{J_{l,i-1} + C_{k,i} + \lambda \cdot R_s(s_{k,i} - s_{l,i-1})\} \tag{3.9}$$

4) Check the index i. If i<N−1, set i=i+1 and go to 3).

After traversing all the states in the Trellis, the optimal path can be extracted by tracing backward from the state with the minimum Lagrangian cost at the last stage. As a result, for a fixed or given $h_t$, the optimal quantized spectral coefficient sequence y and SFs s for all SFBs that minimize the Lagrangian cost are determined.

Reference is now made to FIG. 4, which shows the Trellis process 68 to be used for step 58. The Trellis process 68 follows a similar procedure to Trellis process 66. It is used to attain a solution for step 58 for the optimal quantized spectral coefficient sequence y and Huffman codebooks h for a fixed or given s. The number of states at each stage is now $N_x = N_h$, as shown. Each state at the ith stage represents a Huffman codebook candidate (i.e., h) for the ith SFB. Denote these states as $\gamma_{k,i}$ where $0 \leqq k < N_h$ and $0 \leqq i < N$. Denote $J_{k,i}$ as the minimum accumulative cost from stage 0 to $\gamma_{k,i}$. As in Trellis process 66, there are transition paths between any of two states in neighboring stages. In addition, there are transition paths between any of two states which have identical state numbers (There two states are not restricted within neighboring stages). The optimization procedure for the Trellis process 68 (step 58) is described as follows:

1) For each state in the Trellis, find the best $y_{k,i}$ to minimize the incremental cost in the state by applying soft decision quantization. The minimum incremental cost $C_{k,i}$ is equal to $$C_{k,i} = \min_{y_{k,i}} \{D_w(xr_i, Q^{-1}(s_{k,i}, y_{k,i}) + \lambda \cdot R(y_{k,i})\}. \tag{3.10}$$

Thus, each state of the Trellis is associated with each minimal incremental cost $C_{k,i}$.

2) Initialize all the states and start Trellis search from the initial stage. $J_{k,0} = C_{k,0} + \lambda \cdot R_s(0)$, for all k.

3) For each state k at the ith stage, find the best accumulative cost from the initial stage by examining all the states at the (i−1)th stage leading to the kth state at the ith stage, and by examining states $\gamma_{k,n}$ $(0 \leqq n < i-1)$ leading to the current state. The best path ending at $\gamma_{k,i}$ is the one that has the minimum accumulative cost $J_{k,i}$. $J_{k,i}$ is defined as $$J_{k,i} = \min\left\{\min_{l \in \{0,1,\ldots N_h-1\}} \{J_{l,i-1} + C_{k,i} + \lambda(R_s(s_{k,i} - s_{l,i-1}) + R_h(h_{l,i-1}, h_{k,i}))\}, \min_{n \in \{0,1,\ldots i-2\}} \left\{J_{k,n} + \sum_{t=n+1}^{i} C_{k,t} + \lambda\left(R_h(h_{k,n}, h_{k,i}) + \sum_{t=n+1}^{i} R_s(s_{k,t} - s_{l,t-1})\right)\right\}\right\} \tag{3.11}$$

wherein $R_h(\cdot)$ denotes the bits to encode the Huffman codebooks for the transition path.

4) Check the index i. If i<N−1, set i=1+1 and go to 3).

After traversing all the states in the Trellis, the optimal path can be extracted by tracing backward from the state with the minimum Lagrangian cost at the last stage. As a result, for fixed or given SFs, the optimal quantized spectral coefficient sequence y and Huffman codebooks for all SFBs that minimize the Lagrangian cost are determined.

To develop an intuition for the optimization process 50 using soft-decision quantization described above, consider the following example. Consider a scale factor band of spectral coefficient sequence in AAC encoding:

$$xr = (-1442687.48668, 257886.45517, -363544.22677, -967991.05298)$$

with scale_factor equal to 1, global_gain equal to 63, and masking threshold equal to $9.8776 \times 10^6$. The quantization indices given the hard decision quantization are $$y_h = (5,1,2,4)$$

which needs 17 bits to encode assuming Huffman codebook 10 is applied. An optimized quantization output, obtained from the soft-decision quantization optimization process 50 described above could be $$y_s = (5,2,2,4)$$

which needs 16 bits to encode assuming the same Huffman codebook is applied. The extra weighted distortion introduced by $y_s$ is 0.00402, based on the de-quantizer/decoder defined in the standard. This brings a rate reduction of 1 bit. For $\lambda>0.00402$, this directly leads to a better rate-distortion tradeoff defined by (3.3).

Figure 5:
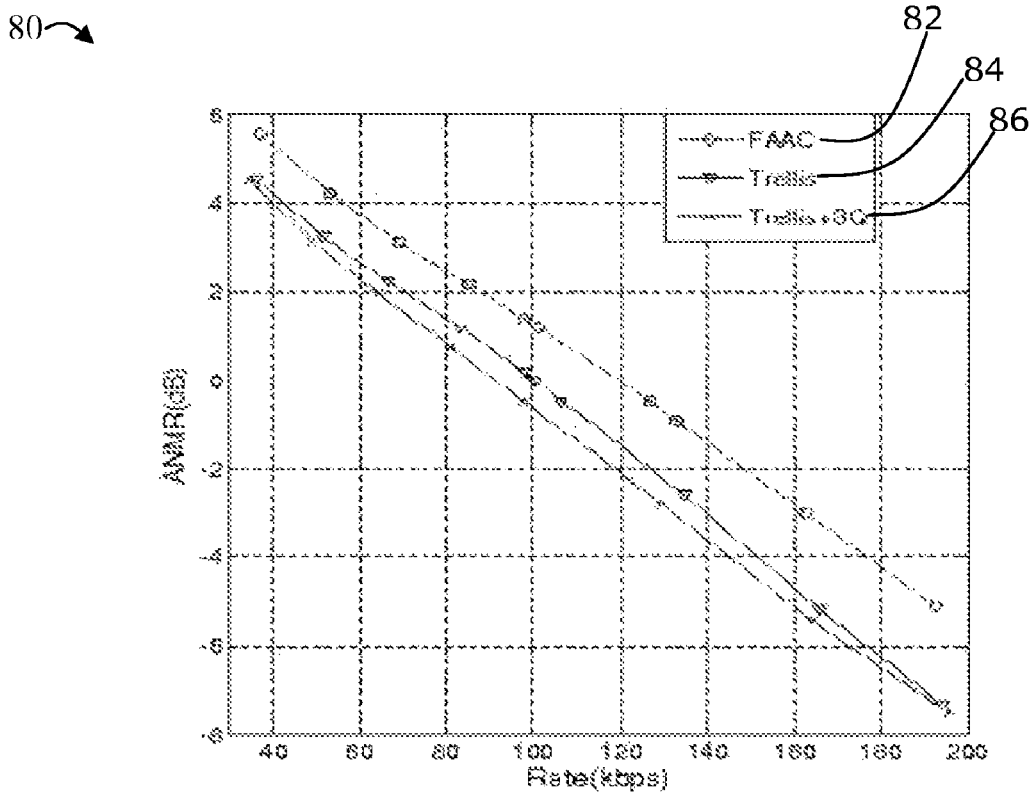
FIG. 5 shows a graph of comparative performance characteristics of an example embodiment, for encoding of audio file Waltz.wav.
Figure 6:
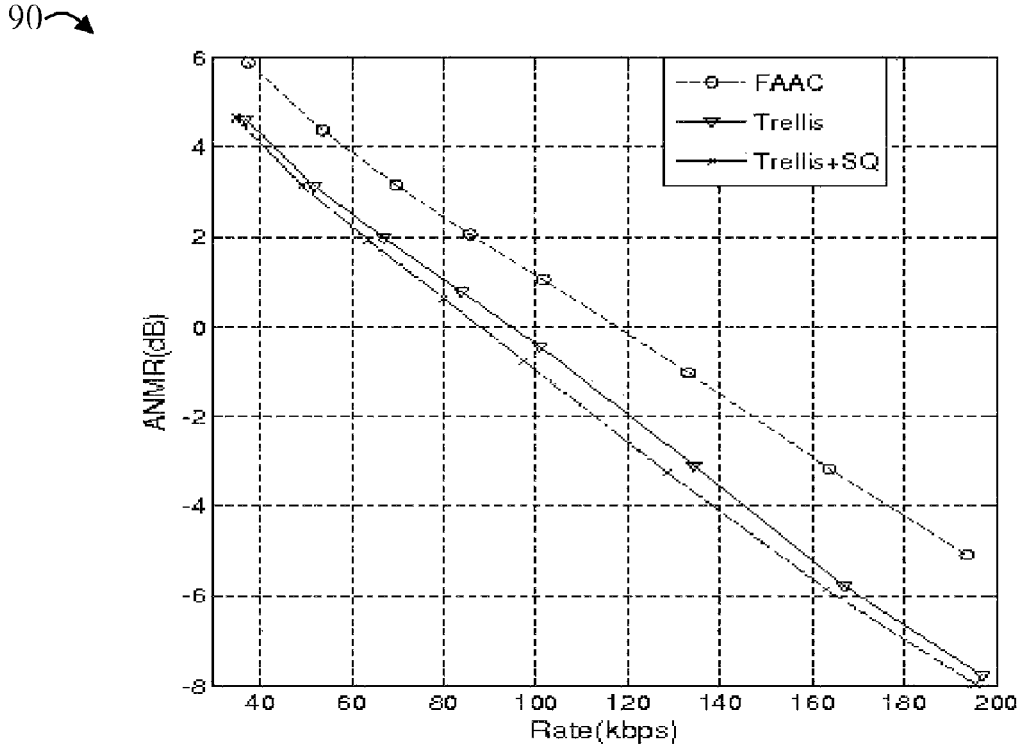
FIG. 6 shows a graph of comparative performance characteristics of an example embodiment for encoding of audio file Violin.wav.
Figure 7:
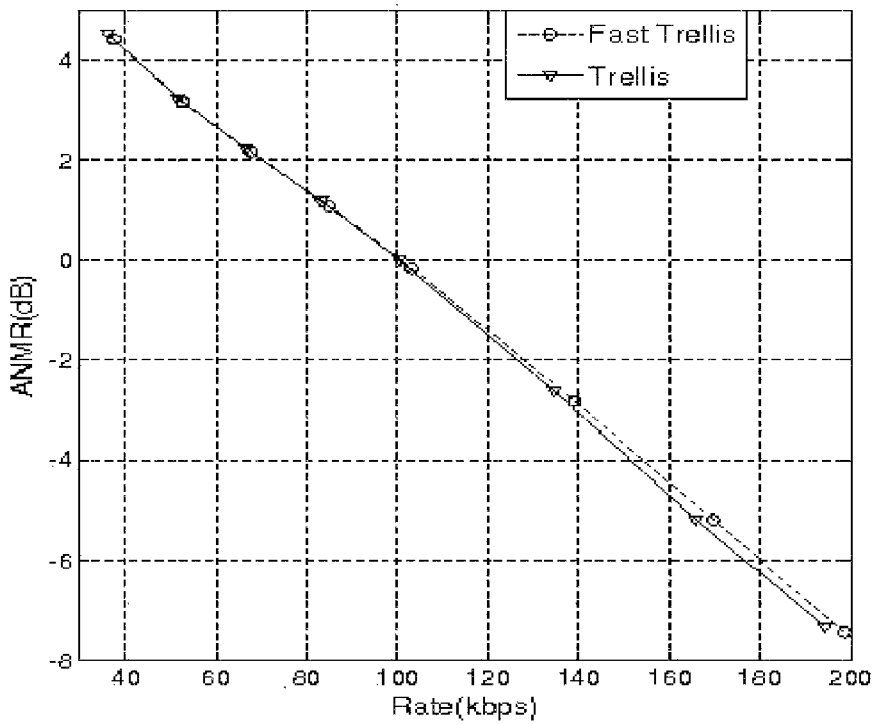
FIG. 7 shows a graph of performance characteristics of an example embodiment, having an alternate configuration, for encoding of audio file Waltz.wav.
Figure 8:
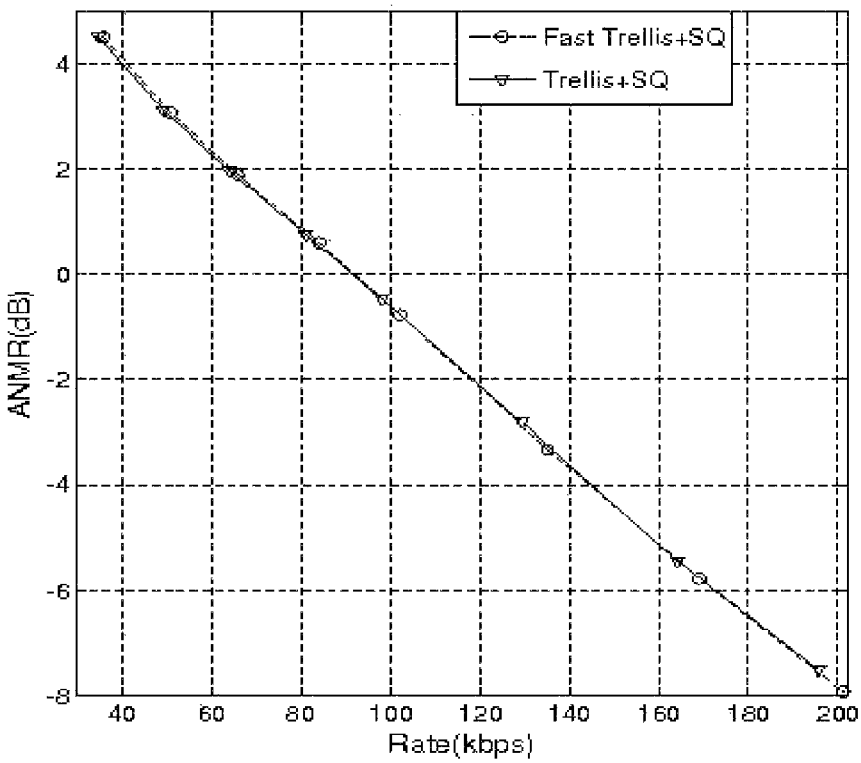
FIG. 8 shows a graph of comparative performance characteristics of an example embodiment, having another alternate configuration, for encoding of audio file Waltz.wav.

Implementation and simulation results of the optimization process 50 will now be described, referring now to FIGS. 5 to 8. FIGS. 5 and 6 show graphs 80, 90 of comparative performance characteristics of an example embodiment using the above-described optimization process using a specified configuration for encoding of audio files Waltz.wav and Violin.wav, respectively. FIGS. 7 and 8 show graphs 100, 110 of performance characteristics, having alternate configurations, for encoding of audio file Waltz.wav.

The estimation of lambda ($\lambda$) will now be briefly described. For a fixed value of $\lambda$, the optimization process 50 may be applied to minimize the encoding cost. As can be understood by those skilled in the art, the following relationship between Perceptual Entropy, signal to noise ratio, signal to mask ratio, encoding rate and the number of audio samples to be encoded:

$$\lambda_{final}^{R}=c_1\times 10^{c_2PE-c_3R} \tag{4.1}$$

where PE is Perceptual Entropy of an encoded frame, and R is the encoding rate. $c_1$, $c_2$ and $c_3$ are determined from the experimental data using the least square criterion. This is for example described in C. Bauer and M. Vinton, "Joint optimization of scale factors and Huffman codebooks for MEPG-4 AAC," in *Proc. of the* 2004 *IEEE workshop on Multimedia Signal Processing*, pp. 111-114, 2004; and C. Bauer and M. Vinton, "Joint optimization of scale factors and Huffman codebooks for MEPG-4 AAC," in *IEEE Trans. on Signal Processing*, vol. 54, pp. 177-189, January 2006, both of which are incorporated herein by reference. Therefore, given a fixed rate, one could use $\lambda_{final}$ determined by the above formula as an initial value for an iterative Lagrangian multiplier search. Due to the close guess of $\lambda_{final}$, significantly less iterations are required than that randomly picks an initial $\lambda$ value.

The simulations may for example be implemented by a FAAC encoder, which is an open source simulation tool for implementing AAC. In some example simulations, Faac_src_26102001 is used, which adopts ISO perceptual model. The optimization process 50 also uses the original FAAC encoder output as the initial point.

The optimization process 50 is implemented as explained above. In the simulation, the search range for $y_j$ is set to $[yh_j-2, yh_j+2]$, where $yh_j$ is the jth quantized coefficient from hard decision quantization (e.g., using (2.1)). The number of possible SFs for each Trellis stage is set to 60. For each case, the perceptual model, joint stereo encoding mode and window switching decision are kept intact, as can be implemented by those skilled in the art.

FIG. 5 depicts a graph 80 showing the rate-distortion performance for the audio test file Waltz.wav. The test file may for example be configured at 48 khz, 2 channel, 16 bits/sample, 30 seconds. In FIG. 5, FAAC 82 represents the results obtained by using the FAAC encoder, Trellis 84 represents the conventional Trellis-based optimized AAC encoder using hard-decision quantization, and Trellis+SQ 86 represents the results from the optimization process 50 (FIG. 2) using soft-decision quantization, as described above. The vertical axes denote the average noise to mask ratio (i.e., distortion) over all audio frames, while the horizontal axes denote the rate in kbps. From FIG. 5, it may be observed that the optimization process 50 achieves a performance gain over the FAAC reference encoder. At 98 kbps, the proposed optimization algorithm achieves 1.858 dB and 0.67 dB ANMR gains over the FAAC reference encoder and Trellis-based optimized AAC encoder respectively, which is equivalent to 22.6% and 8% compression rate gains respectively.

FIG. 6 shows a graph 90 of another simulation, performed in a similar manner as the simulation shown in FIG. 5, for the audio coding of test file Violin.wav. The test file may for example be configured at 48 khz, 2 channel, 16 bits/sample, 30 seconds. Improvements in rate-distortion are shown in the graph 90. Similar results may be achieved for other test music files.

The computational complexity and additional methods of reducing thereof will now be described, referring still to FIGS. 5 and 6. Given the value of $\lambda$, the number of iterations in the optimization process 50 has a direct impact on the computational complexity. Experiments show that by setting the convergence tolerance $\epsilon$ to 0.005, the iteration process is observed to converge after 3 loops in most cases, that is, most of the gain achievable from full joint optimization is obtained within 3 iterations. Compared with the direct search using dynamic programming, for example, "Joint optimization of scale factors and Huffman codebooks for MEPG-4 AAC," in *IEEE Trans. on Signal Processing*, vol. 54, pp. 177-189, January 2006, the computational complexity has been reduced from $O((N_s\cdot N_h)^2N)$ to $O((N_s^2+N_h^2)\cdot 3N)$. This is equivalent to 46 times faster if $N_s=60$, $N_h=12$ and $N=49$. As described in the previous subsection, the search range for $y_j$ in soft-decision quantization is set to $[yh_j-a, yh_j+a]$, where $yh_j$ is the jth quantized coefficient from hard decision quantization, and a is a fixed integer (e.g. a=2 for simulation purposes). The number of possible SFs at each stage is set to 60. In some example embodiments, further expansion of the search range for $y_j$ and SFs would not significantly improve the compression performance.

Reference is now made to FIGS. 7 and 8, which show simulation results in alternate configurations, which may for example be used to reduce computational complexity.

TABLE 1

Computation time in seconds for different AAC encoders

| | Bit rates (kbps) | | | | | | | |
|---|---|---|---|---|---|---|---|---|
| | 36 | 50 | 66 | 80 | 98 | 128 | 160 | 192 |
| FAAC encoder | 14 | 14 | 15 | 15 | 15 | 15 | 15 | 11 |
| Trellis | 77 | 78 | 80 | 80 | 79 | 71 | 64 | 57 |
| Trellis + SQ | 255 | 276 | 318 | 337 | 306 | 447 | 433 | 426 |

Table 1 lists the computation time in seconds on a Pentium PC, 2.16 GHZ, 1 G bytes of RAM to encode waltz.wav at different bit rates for three different encoders. FIGS. 7 and 8 represent simulations configured to further improve the computation speed in two aspects. First, the number of possible SFs could be reduced to 50. In some example embodiments, this does not contribute significantly to any performance loss. Second, as the interim outputs from the iterative algorithm converge to the final output gradually, it is possible and reasonable to decrease the number of SFs for the dynamic programming search one iteration after another. In the simulation, the number of SFs is set to 16 and 8 respectively during the second and third iterations.

TABLE 2

| Computation time in seconds for fast optimized AAC encoders | | | | | | | | |
|---|---|---|---|---|---|---|---|---|
| | Bit rates (kbps) | | | | | | | |
| | 36 | 50 | 66 | 80 | 98 | 128 | 160 | 192 |
| Fast Trellis | 42 | 42 | 42 | 42 | 40 | 36 | 33 | 30 |
| Fast Trellis + SQ | 169 | 186 | 190 | 184 | 185 | 195 | 173 | 168 |

Table 2 lists the computation time in seconds to encode Waltz.wav for the two optimized encoders after applying the above changes. Fast Trellis refers to implementing the above two changes on conventional hard-decision quantization. FIG. 7 accordingly shows the performance for Fast Trellis versus Trellis (conventional hard-decision quantization). Fast Trellis+SQ refers to implementing the above two changes on the optimization process 50 using soft-decision quantization. FIG. 8 accordingly shows the performance for Fast Trellis+SQ versus Trellis+SQ. As shown, the computational complexity may be reduced significantly after reducing the number of possible scale factors. At the same time, the performance loss is relatively small. In particular, the fast Trellis-based optimized AAC encoder may realize near real time throughput.

As can be appreciated, the two above-mentioned configurations for improving computational time (for providing "fast" implementation) may be implemented by other methods, and are not limited to the Fast Trellis and Fast Trellis+SQ simulations described herein.

Figure 9:
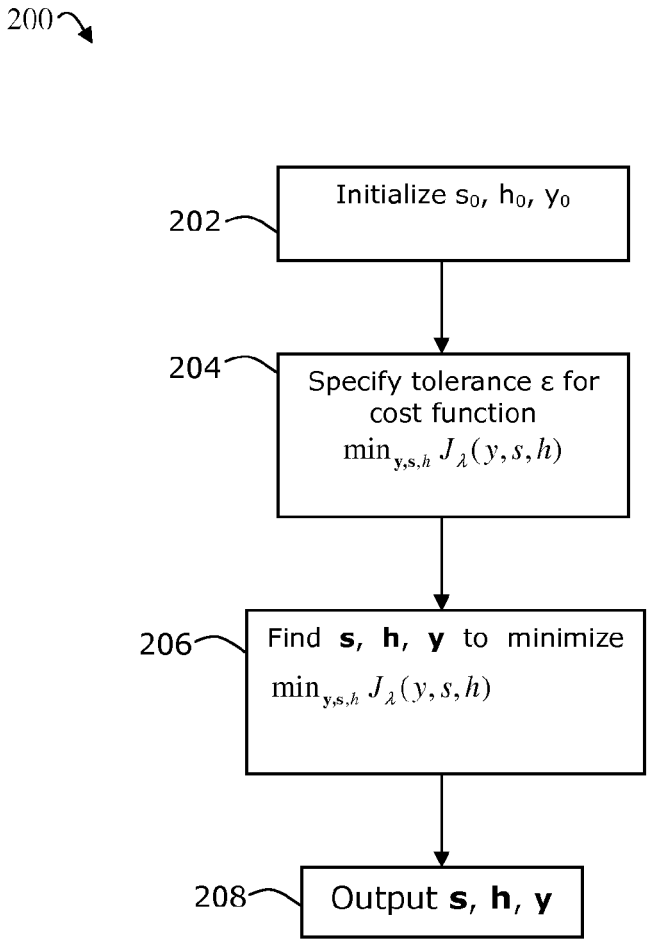
FIG. 9 shows a method for optimizing performance of AAC in accordance with an example embodiment.

Reference is now made to FIG. 9, which shows a method 200 for optimizing performance of AAC of a source sequence in accordance with an example embodiment. At step 202, the method 200 defines and initializes a quantized spectral coefficient sequence (y) as a quantized sequence of the source sequence to be determined, Huffman codebooks (h) from a set of selectable Huffman codebooks, and a scale factor sequence (s) corresponding to quantization step sizes of the quantized spectral coefficient sequence. At step 204, there is provided a cost function (J) based on distortion and bit rate transmission of an encoding of the source sequence, the cost function being dependent on the quantized spectral coefficient sequence (y), the scale factor sequence (s), and the Huffman codebooks (h). A tolerance $\epsilon$ is also specified as a tolerance for the cost function (J).

At step 206, the method 200 determines the quantized spectral coefficient sequence (y) which minimizes the cost function (J) within the predetermined tolerance $\epsilon$. As shown, the method may also minimize the scale factor sequence (s) and the Huffman codebooks (h). At step 208, the method outputs y, s and h as parameters for performing of Advanced Audio Coding of the source sequence.

Figure 10:
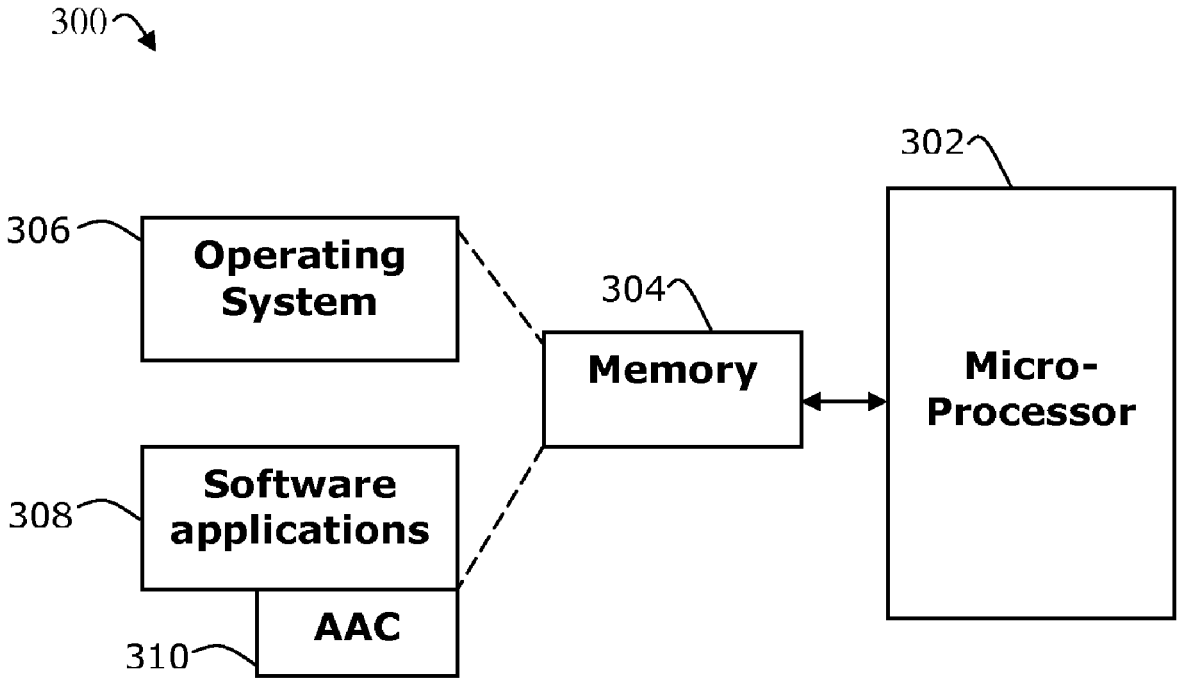
FIG. 10 shows an encoder for optimizing performance of AAC in accordance with an example embodiment.

Reference is now made to FIG. 10, which shows an encoder 300 in accordance with an example embodiment. The encoder 300 may for example be implemented on a suitable configured computer device. The encoder 300 includes a controller such as a microprocessor 302 that controls the overall operation of the encoder 300. The microprocessor 302 may also interact with other subsystems (not shown) such as a communications subsystem, display, and one or more auxiliary input/output (I/O) subsystems or devices. The encoder 300 includes a memory 304 accessible by the microprocessor 302. Operating system software 306 and various software applications 308 used by the microprocessor 302 are, in some example embodiments, stored in memory 304 or similar storage element. For example, AAC software application 310, such as the FAAC encoder software described above, may be installed as one of the various software applications 308. The microprocessor 302, in addition to its operating system functions, in example embodiments enables execution of software applications 308 on the device.

The encoder 300 may be used for optimizing performance of AAC of a source sequence. Specifically, the encoder 300 may enable the microprocessor 302 to determine a quantized spectral coefficient sequence as a quantized sequence of the source sequence. The memory 304 may contain a cost function of an encoding of the source sequence, wherein the cost function is dependent on the quantized spectral coefficient sequence. The memory 304 may also contain a predetermined threshold of the cost function stored in the memory 304. Instructions residing in memory 304 enable the microprocessor 302 to access the cost function and predetermined threshold from memory 304, determine the quantized spectral coefficient sequence which minimizes the cost function within the predetermined threshold, and store the determined quantized spectral coefficient sequence in memory 304 for AAC of the source sequence. For example, AAC software application 310 may be used to perform AAC using the determined quantized spectral coefficient sequence.

In another example embodiment, the encoder 300 may be configured for optimizing of quantized spectral coefficient sequences, in a manner similar to the example methods described above.

In another example embodiment, the encoder 300 may further be configured for jointly optimizing performance of scale factors, Huffman codebooks and quantized spectral coefficient sequences, in a manner similar to the example methods described above.

While example embodiments have been described in detail in the foregoing specification, it will be understood by those skilled in the art that variations may be made without departing from the scope of the present application.

What is claimed is:

1. A method for optimizing performance of Advanced Audio Coding of an audio source sequence, the Advanced Audio Coding being dependent on a quantized spectral coefficient sequence, on a scale factor sequence, and on Huffman codebooks, wherein the quantized spectral coefficient sequence is a quantized sequence of the audio source sequence, the scale factor sequence corresponds to quantization step sizes of the quantized spectral coefficient sequence, and the Huffman codebooks are from a set of selectable Huffman codebooks, the method comprising:

determining values of the quantized spectral coefficient sequence, the scale factor sequence, and the Huffman codebooks which minimize a cost function of an encoding of the audio source sequence within a predetermined threshold, the cost function being dependent on the quantized spectral coefficient sequence, the scale factor sequence, and the Huffman codebooks, by initializing fixed values of one of the quantized spectral coefficient sequence, the scale factor sequence, and the Huffman codebooks, and iteratively performing:

determining, for the fixed values of the one of the quantized spectral coefficient sequence, the scale factor sequence, and the Huffman codebooks, values of the other two of the quantized spectral coefficient sequence, the scale factor sequence, and the Huffman codebooks which minimize the cost function, determining, for one of the determined values of the other two, values of the remaining two of the quantized spectral coefficient sequence, the scale factor sequence, and the Huffman codebooks which minimize the cost function, and fixing the determined values of the remaining two of the quantized spectral coefficient sequence, the scale factor sequence, and the Huffman codebooks, and determining whether the cost function is within a predetermined threshold, and if so ending the iteratively performing; and performing Advanced Audio Coding of the audio source sequence using the determined quantized spectral coefficient sequence, the determined scale factor sequence, and the determined Huffman codebooks.

2. The method claimed in claim 1, wherein the cost function is dependent on distortion of and transmission bit rate of an encoding of the audio source sequence.

3. The method claimed in claim 1, wherein said initialized fixed values are the Huffman codebooks for determining the quantized spectral coefficient sequence and the scale factor sequence which minimize the cost function, and further wherein said one of the determined values is the determined values of the scale factor sequence for determining the quantized spectral coefficient sequence and the Huffman codebooks which minimize of the cost function.

4. The method claimed in claim 1, wherein at least one of said determining includes implementing a Trellis-based process for minimization.

5. The method claimed in claim 3, wherein said determining the quantized spectral coefficient sequence and the scale factor sequence includes implementing a Trellis-based process which includes:

providing a Trellis structure having N stages, each stage having $N_s$ states, wherein the states correspond to a range of scale factors;

associating each state at each stage of the Trellis structure with a respective minimum incremental cost of the quantized spectral coefficient sequence;

initializing a Trellis search from all k states at an initial stage i=0;

finding, for each kth state at the ith stage, wherein $0<i\leqq N-1$, a minimal accumulative cost entering into the kth state at the ith stage from the initial stage by examining states at the (i−1)th stage leading to the kth state at the ith stage; and determining an optimal path by tracing backward from the state with the minimal accumulative cost at a last stage i=N−1.

6. The method claimed in claim 3, wherein said determining the quantized spectral coefficient sequence and the Huffman codebooks includes implementing a Trellis-based process which includes:

providing a Trellis structure having N stages, each stage having $N_h$ states, wherein the states correspond to a range of Huffman codebooks;

associating with each state at each stage of the Trellis structure with a respective minimum incremental cost of the quantized spectral coefficient sequence;

initializing a Trellis search from all k states at an initial stage 1=0;

finding, for each kth state at the ith stage, wherein $0<i\leqq N-1$, a minimal accumulative cost entering into the kth state at the ith stage from the initial stage by examining states at the (i−1)the stage leading to the kth state at the ith stage, and by examining the kth state at the nth stage, wherein $0\leqq n<i-1$, leading to the kth state at the ith stage; and determining an optimal path by tracing backward from the state with the minimal accumulative cost at a last stage i=N−1.

7. The method claimed in claim 1, further comprising initializing the quantized spectral coefficient sequence by calculating a function dependent on the scale factor sequence and the audio source sequence, resulting in an initialized quantized spectral coefficient sequence.

8. The method claimed in claim 7, further comprising limiting the determining of the quantized spectral coefficient sequence to within a search range dependent on the initialized quantized spectral coefficient sequence.

9. The method claimed in claim 8, wherein the search range is [yh−a, yh+a], wherein yh is the initialized quantized spectral coefficient sequence and a is a fixed integer.

10. The method claimed in claim 1, wherein the scale factor sequence is differentially encoded, the method further comprising limiting the determining of the scale factor sequence to within a search range.

11. The method claimed in claim 10, further comprising limiting the range of scale factor sequences to within the search range in a first iteration of said determining, and further limiting the search range of scale factor sequences in subsequent iterations of said determining.

12. An encoder for optimizing performance of Advanced Audio Coding of an audio source sequence, the Advanced Audio Coding being dependent on a quantized spectral coefficient sequence, wherein the quantized spectral coefficient sequence is a quantized sequence of the audio source sequence, the encoder comprising:

a controller;

a memory accessible by the controller; and a predetermined threshold stored in the memory, wherein the controller is configured to:

access the predetermined threshold from memory, determine values of the quantized spectral coefficient sequence which minimize a cost function within the predetermined threshold, by using soft decision quantization, the cost function being dependent on the quantized spectral coefficient sequence, by initializing fixed values of one of the quantized spectral coefficient sequence, the scale factor sequence, and the Huffman codebooks, and iteratively performing:

determining, for the fixed values of the one of the quantized spectral coefficient sequence, the scale factor sequence, and the Huffman codebooks, values of the other two of the quantized spectral coefficient sequence, the scale factor sequence, and the Huffman codebooks which minimize the cost function, determining, for one of the determined values of the other two, values of the remaining two of the quantized spectral coefficient sequence, the scale factor sequence, and the Huffman codebooks which minimize the cost function, and fixing the determined values of the remaining two of the quantized spectral coefficient sequence, the scale factor sequence, and the Huffman codebooks, and determining whether the cost function is within a predetermined threshold, and if so ending the iteratively performing, and store the determined quantized spectral coefficient sequence in memory for Advanced Audio Coding of the audio source sequence.

13. The encoder claimed in claim 12, wherein the controller further limits the determining of the values of the quantized spectral coefficient sequence to within a search range dependent on the initialized quantized spectral coefficient sequence.

14. An encoder for optimizing performance of Advanced Audio Coding of an audio source sequence, the Advanced Audio Coding being dependent on a quantized spectral coefficient sequence, a scale factor sequence, and Huffman codebooks, wherein the quantized spectral coefficient sequence is a quantized sequence of the audio source sequence, the scale factor sequence corresponds to quantization step sizes of the quantized spectral coefficient sequence, and the Huffman codebooks are from a set of selectable Huffman codebooks, the encoder comprising:

a controller;

a memory accessible by the controller; and a predetermined threshold stored in the memory, wherein the controller is configured to:

access the predetermined threshold from memory, determine values of the quantized spectral coefficient sequence, the scale factor sequence, and the Huffman codebooks which minimize a cost function of an encoding of the audio source sequence within the predetermined threshold, the cost function being dependent on the quantized spectral coefficient sequence, the scale factor sequence, and the Huffman codebooks, by initializing fixed values of one of the quantized spectral coefficient sequence, the scale factor sequence, and the Huffman codebooks, and iteratively performing:

determining, for the fixed values of the one of the quantized spectral coefficient sequence, the scale factor sequence, and the Huffman codebooks, values of the other two of the quantized spectral coefficient sequence, the scale factor sequence, and the Huffman codebooks which minimize the cost function, determining, for one of the determined values of the other two, values of the remaining two of the quantized spectral coefficient sequence, the scale factor sequence, and the Huffman codebooks which minimize the cost function, and fixing the determined values of the remaining two of the quantized spectral coefficient sequence, the scale factor sequence, and the Huffman codebooks, and determining whether the cost function is within a predetermined threshold, and if so ending the iteratively performing, and store the determined quantized spectral coefficient sequence, the scale factor sequence, and the Huffman codebooks in memory for Advanced Audio Coding of the audio source sequence.

15. An encoder for optimizing performance of Advanced Audio Coding of an audio source sequence, wherein the encoder is configured to perform the method claimed in claim 1.

* * * * *